US007609989B2

(12) United States Patent
Harada

(10) Patent No.: US 7,609,989 B2
(45) Date of Patent: Oct. 27, 2009

(54) SYSTEM AND CONTROL METHOD FOR GENERATING AN IMAGE HAVING A LATENT PATTERN WITH OR WITHOUT A BACKGROUND PATTERN

(75) Inventor: Koji Harada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 544 days.

(21) Appl. No.: 11/421,783

(22) Filed: Jun. 2, 2006

(65) Prior Publication Data

US 2006/0280515 A1 Dec. 14, 2006

(30) Foreign Application Priority Data

Jun. 13, 2005 (JP) ..... 2005-172965

(51) Int. Cl.
*G03G 15/00* (2006.01)

(52) U.S. Cl. ..... 399/80; 399/81; 399/366

(58) Field of Classification Search ..... 399/80, 399/81, 366
See application file for complete search history.

(56) References Cited

U.S. PATENT DOCUMENTS

| | | | |
|---|---|---|---|
| 2004/0003240 | A1 | 1/2004 | Lai et al. |
| 2005/0078974 | A1 | 4/2005 | Uchida et al. |
| 2007/0025787 | A1 | 2/2007 | Harada |

FOREIGN PATENT DOCUMENTS

| | | |
|---|---|---|
| CN | 1402137 | 3/2003 |
| JP | 2001-197297 | 7/2001 |
| JP | 2001-238075 | 8/2001 |
| JP | 2002-305646 | 10/2002 |
| JP | 2003-067249 | 3/2003 |
| JP | 2003-276370 | 9/2003 |
| JP | 2004-268424 | 9/2004 |

OTHER PUBLICATIONS

Electronic Translation of JP 2002305646, Matsunoshita et al.*
English Translation of JP 2001238075, Suzuki Aug. 31, 2001.*

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

A condition determination unit (102) determines a to-be-used copy-forgery-inhibited-pattern image from a first copy-forgery-inhibited-pattern image generated using a latent pattern designed as a pattern that becomes visible upon copy and a background pattern designed as a pattern that becomes invisible upon copy and a second copy-forgery-inhibited-pattern image generated using the latent pattern. A tint block image generation unit (105) generates the determined copy-forgery-inhibited-pattern image. A combining unit (106) combines the generated copy-forgery-inhibited-pattern image with a print target image. A print data processing unit (107) generates print data on the basis of the combined data and outputs the print data to a printer (108).

11 Claims, 5 Drawing Sheets

SYSTEM AND CONTROL METHOD FOR GENERATING AN IMAGE HAVING A LATENT PATTERN WITH OR WITHOUT A BACKGROUND PATTERN

FIELD OF THE INVENTION

The present invention relates to a technique of processing data for printing.

BACKGROUND OF THE INVENTION

Receipts, securities, and certificates sometimes have special patterns which are printed on the background and contain a text or image visible in a copy so they cannot easily be copied. Such a special pattern is generally called an anti-counterfeit pattern which is designed to prevent easy duplication of an original and serves as a psychological deterrent to copy of the original.

An anti-counterfeit pattern has two regions with the same density: a region where dots remain after copy and a region where dots disappear after copy. The densities of the two regions almost equal. Macroscopically, no hidden image or text such as "copy product" can be perceived. However, the regions have different microscopic characteristics. The hidden text or image will be referred to as a latent image.

For example, the region (called a latent part) where dots remain after copy includes dot blocks with concentrated dots. The region (called a background part) where dots disappear after copy includes dispersed dots. In this way, two regions which have almost the same density and different characteristics can be formed.

The concentrated dots and dispersed dots can be generated by halftoning processing using halftone dots with different screen rulings or dither processing using dither matrices with different features.

A copying machine generally has a limitation of image reproduction capability depending on the input resolution to read tiny dots of a copy document or the output resolution to reproduce tiny dots. If isolated tiny dots beyond the limitation of the image reproduction capability of the copying machine are present in a document, the tiny dots cannot completely be reproduced in a copy product, and the part of the isolated tiny dots drops out.

When the background part of the anti-counterfeit pattern is designed to exceed the limitation of dots reproducible by the copying machine, large dots (concentrated dots) of the anti-counterfeit pattern can be reproduced by copy, although small dots (dispersed dots) cannot be reproduced. Hence, a hidden image (latent image) becomes visible. Even when the dispersed dots do not completely disappear upon copy but obviously have a density difference to the concentrated dots, the hidden image (latent image) also becomes visible.

For the anti-counterfeit pattern, a "camouflage" technique of making a hidden text or image (latent image) more indistinguishable is also known well.

In camouflage, a pattern having a density different from that of the latent part and background part is laid out on the entire anti-counterfeit pattern image. Macroscopically, the camouflage pattern having a density different from that of the latent part and background part is noticeable, and the latent image is more unnoticeable.

An anti-counterfeit pattern containing a camouflage pattern can give a decorative impression to a printed product as compared to an anti-counterfeit pattern without a camouflage pattern.

To easily discriminate the latent image after copy, dots in the camouflage pattern preferably disappear as much as possible after copy. In the simplest implementation, camouflage can be realized by omitting dots in a portion corresponding to the camouflage pattern.

An outline of the anti-counterfeit pattern has been described above (Japanese Patent Laid-Open No. 2001-197297).

Conventionally, printing paper makers print copy-forgery-inhibited-patterns containing a text such as "copy product" or image (latent image) on dedicated paper in advance and sells the paper as anti-copy paper. Government and municipal offices or corporations purchase the anti-copy paper and print documents whose integrity must be guaranteed on the anti-copy paper, thereby deterring copy of the printed product.

The conventional anti-copy paper is produced by the printing paper makers by preprinting copy-forgery-inhibited-patterns on dedicated paper. For this reason, there are disadvantages in terms of cost such as the cost of dedicated paper and the cost accrued by preparing preprinted paper sheets more than necessary.

Recently, however, a technique (called an on-demand copy-forgery-inhibited-pattern output method by a printer) is implemented which creates an anti-counterfeit pattern image by using software and causes a laser printer to output a document with an anti-counterfeit pattern being laid out on the background.

In the on-demand copy-forgery-inhibited-pattern output method by a printer, a document with an anti-counterfeit pattern being laid out on the background can be printed by using normal paper. The document with an anti-counterfeit pattern being laid out on the background can be printed in necessary number at a necessary time. Hence, preprinted paper sheets need not be prepared more than necessary, unlike the prior art. For this reason, in the on-demand copy-forgery-inhibited-pattern output method by a printer, the cost of paper can greatly be reduced as compared to the conventional document copy deterring method using anti-copy paper.

An anti-counterfeit pattern makes it possible to discriminate between a copied product and an original product on the basis of a pattern that appears after copy. Since illicit use of a copied product can be prevented, an effect of psychologically deterring copy can be expected. As described in relation to the prior art, the on-demand copy-forgery-inhibited-pattern output method by a printer is excellent because the anti-counterfeit pattern can be generated easily at a low cost.

In addition, the need for the security of documents is growing more than ever as the electronic documents act comes into effect. The copy-forgery-inhibited-pattern is also required to have measures to strengthen the effects of deterring and tracking unauthorized copy and the reliability of integrity security.

SUMMARY OF THE INVENTION

The present invention has been made in consideration of the above-described problems, and has as its object to provide a technique of controlling a copy-forgery-inhibited-pattern to be used in accordance with a situation in printing using a copy-forgery-inhibited-pattern.

In order to achieve an object of the present invention, for example, an image processing apparatus of the present invention comprises the following arrangement.

That is, an image processing apparatus comprising:

acquisition unit for acquiring user information; and determination unit for determining on the basis of the user information acquired by the acquisition unit whether to generate an image containing a latent pattern and a background pattern or an image containing the latent pattern but no background pattern.

In order to achieve an object of the present invention, for example, an image processing method of the present invention comprises the following arrangement.

That is, an image processing method comprising:

an acquisition step of acquiring user information; and a determination step of determining on the basis of the user information acquired in the acquisition step whether to generate an image containing a latent pattern and a background pattern or an image containing the latent pattern but no background pattern.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

Figure 1:
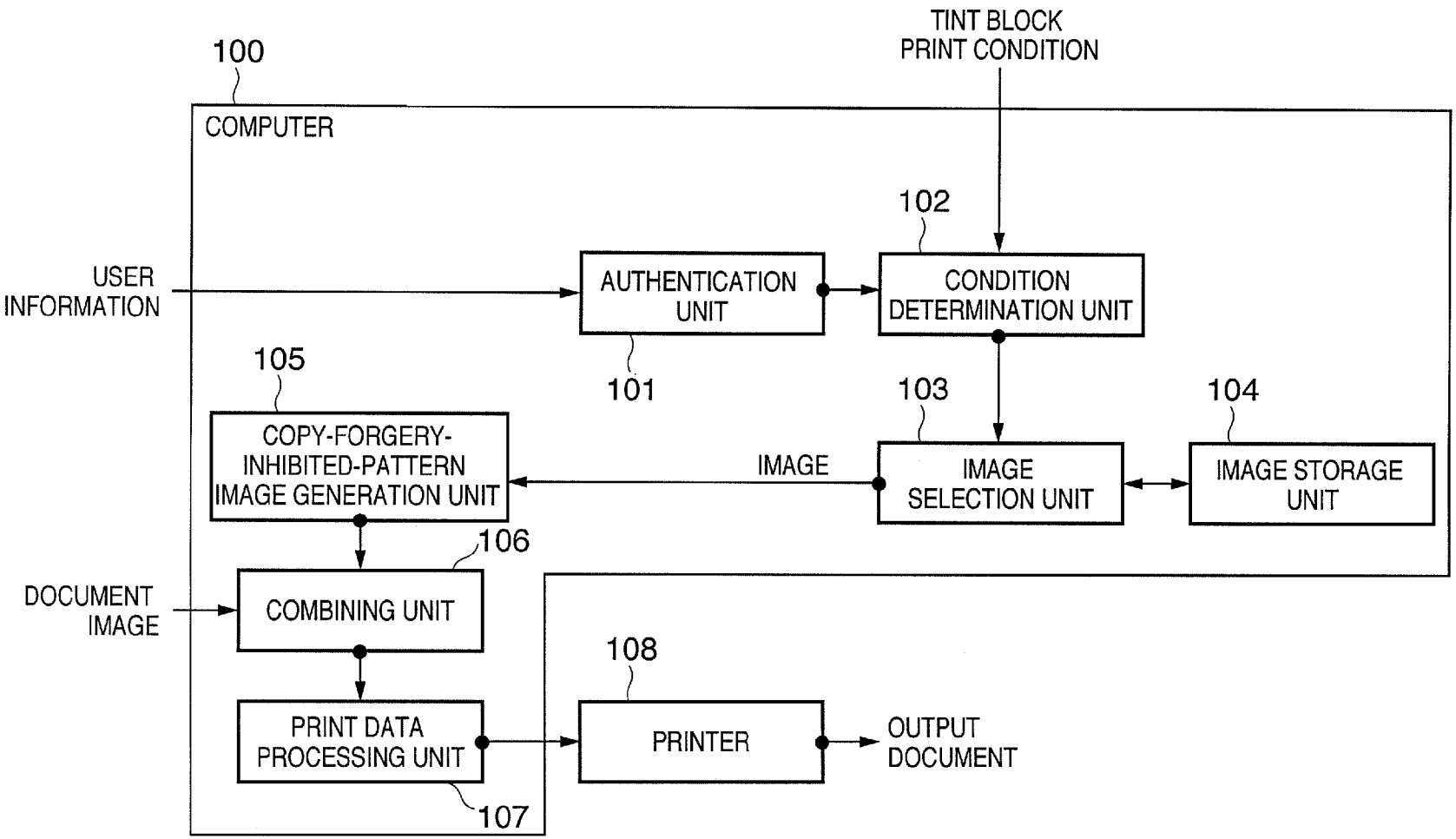
FIG. 1 is a block diagram showing the functional configuration of a system according to the first embodiment of the present invention which executes printing based on an image obtained by combining a print target image with a copy-forgery-inhibited-pattern image.

FIG. 1 is a block diagram showing the functional configuration of a system according to this embodiment which executes printing based on an image obtained by combining a print target image with a copy-forgery-inhibited-pattern image. As shown in FIG. 1, the system according to this embodiment includes a computer 100 and a printer 108.

The computer 100 will be described first. The computer 100 includes an authentication unit 101, condition determination unit 102, image selection unit 103, image storage unit 104, copy-forgery-inhibited-pattern image generation unit 105, combining unit 106, and print data processing unit 107, as shown in FIG. 1. In this embodiment, all the units included in the computer 100 are formed from dedicated hardware. However, they may partially include software.

The authentication unit 101 acquires information (user information) about the operator (user) of the computer 100, specifies the user by using the acquired user information, and outputs information (user specific information) unique to the specified user to the condition determination unit 102.

Examples of the user information are information such as a password and user name assigned to the user in advance and biometrical information such as an iris and fingerprint. The form of user information acquisition by the authentication unit 101 is not particularly limited. For example, user information may be acquired by recording it on a magnetic card and causing a card reader to read out the user information. Alternatively, user information that is input by the operator of the computer 100 through an information input interface such as a keyboard may be acquired. An example of the user specific information is a user ID.

The authentication unit 101 holds user information and user specific information corresponding to it in advance in association with each other for each user. Upon acquiring user information, the authentication unit 101 specifies user specific information that is held in association with the user information. Then, the authentication unit 101 outputs the specified user specific information to the condition determination unit 102.

The series of processes by the authentication unit 101, i.e., the series of user authentication processes of acquiring user information and outputting user specific information corresponding to the acquired user information is a known technique, and a more detailed description thereof will be omitted.

The condition determination unit 102 determines a copy-forgery-inhibited-pattern image to be combined with a print target image on the basis of the user specific information received from the authentication unit 101. In this embodiment, two kinds of copy-forgery-inhibited-pattern images are prepared. One is a first copy-forgery-inhibited-pattern image, and the other is a second copy-forgery-inhibited-pattern image. The first and second copy-forgery-inhibited-pattern images will be described later. The condition determination unit 102 selects a copy-forgery-inhibited-pattern image to be combined with a print target image from the first copy-forgery-inhibited-pattern image and second copy-forgery-inhibited-pattern image on the basis of the user specific information received from the authentication unit 101.

For this purpose, a condition (copy-forgery-inhibited-pattern print condition) to use the first copy-forgery-inhibited-pattern image (or second copy-forgery-inhibited-pattern image) is input to the condition determination unit 102 for each user.

For example, to limit the number of copies using the first copy-forgery-inhibited-pattern image for each user, the copy-forgery-inhibited-patternprint condition is, e.g., "the allowable number of copies printed by using the first copy-forgery-inhibited-pattern image is [5] for Mr. A and [3] for Mr. B (example 1)".

To limit printing using the first copy-forgery-inhibited-pattern image for each department, the copy-forgery-inhibited-pattern print condition is, e.g., "printing using the first copy-forgery-inhibited-pattern image is permitted for the sales department and inhibited for the planning department (example 2)".

The copy-forgery-inhibited-pattern print condition may be held in the condition determination unit 102 in advance or acquired from the outside every time a print request is issued.

In example 1, the condition determination unit 102 holds the number of copies printed in the past by Mr. A and Mr. B using the first copy-forgery-inhibited-pattern image. If the user specific information received from the authentication unit 101 indicates Mr. A, and the number of copies printed in the past by Mr. A using the first copy-forgery-inhibited-pattern image is [5] or less, the condition determination unit 102 determines to use the first copy-forgery-inhibited-pattern image. If the number of copies is larger than [5], the condition determination unit 102 determines to use the second copy-forgery-inhibited-pattern image. Even when the user specific information received from the authentication unit 101 indicates Mr. B, the processing of determining the copy-forgery-inhibited-pattern image to be used is executed in the same way.

In example 2, the condition determination unit 102 holds data indicating departments to which users belong. If the user specific information received from the authentication unit 101 indicates a user belonging to the sales department, the condition determination unit 102 determines to use the first copy-forgery-inhibited-pattern image. If the user specific information indicates a user belonging to the planning department, the condition determination unit 102 determines to use the second copy-forgery-inhibited-pattern image.

The condition determination unit 102 notifies the image selection unit 103 of the "to-be-used copy-forgery-inhibited-pattern image" which is determined in the above-described way. In accordance with the notification received from the condition determination unit 102, the image selection unit 103 reads out both of a latent pattern and a background pattern or only the latent pattern from the image storage unit 104 and outputs it to the copy-forgery-inhibited-pattern image generation unit 105.

The latent pattern and background pattern will be described here. In the latent pattern, dots are concentrated to form a region where dots representing a text such as "copied product" or "COPY" remain upon copy. In other words, the latent pattern is formed as a visible pattern upon copy. On the other hand, in the background pattern, dots are dispersed to form a region where dots disappear upon copy. In other words, the background pattern is formed as an invisible pattern upon copy.

The image storage unit 104 stores the image data of the latent pattern and the image data of the background pattern. Upon receiving a notification to "use the first copy-forgery-inhibited-pattern image" from the condition determination unit 102, the image selection unit 103 reads out the latent pattern and background pattern from the image storage unit 104 and outputs them to the copy-forgery-inhibited-pattern image generation unit 105. Upon receiving a notification to "use the second copy-forgery-inhibited-pattern image" from the condition determination unit 102, the image selection unit 103 reads out only the latent pattern from the image storage unit 104 and outputs it to the copy-forgery-inhibited-pattern image generation unit 105.

The image storage unit 104 may store the image data of the camouflage pattern in addition to the latent pattern and background pattern. When a notification to "use the first copy-forgery-inhibited-pattern image" is received from the condition determination unit 102, the image data of the camouflage pattern may also be read out from the image storage unit 104 in addition to the latent pattern and background pattern and output to the copy-forgery-inhibited-pattern image generation unit 105.

The copy-forgery-inhibited-pattern image generation unit 105 creates a copy-forgery-inhibited-pattern image by using the image data output from the image selection unit 103. When the latent pattern and background pattern are received from the image selection unit 103, the copy-forgery-inhibited-pattern image generation unit 105 repeatedly pastes the pattern images in a region with a predetermined size without overlap, thereby generating one first copy-forgery-inhibited-pattern image. When the camouflage pattern is also received from the image selection unit 103 in addition to the latent pattern and background pattern, the copy-forgery-inhibited-pattern image generation unit 105 repeatedly pastes the images of the latent pattern, background pattern, and camouflage pattern in a region with a predetermined size without overlap, thereby generating one first copy-forgery-inhibited-pattern image.

When only the latent pattern is received from the image selection unit 103, the copy-forgery-inhibited-pattern image generation unit 105 repeatedly pastes the image of the received latent pattern in a region with a predetermined size without overlap, thereby generating one second copy-forgery-inhibited-pattern image.

The copy-forgery-inhibited-pattern image generation unit 105 outputs the image data of the generated copy-forgery-inhibited-pattern image (first copy-forgery-inhibited-pattern image or second copy-forgery-inhibited-pattern image) to the combining unit 106.

Print target image data (e.g., document image data) is input to the combining unit 106. The combining unit 106 creates combined data by combining the print target image with the copy-forgery-inhibited-pattern image output from the copy-forgery-inhibited-pattern image generation unit 105 and outputs the created combined data to the print data processing unit 107.

The print data processing unit 107 receives the combined data from the combining unit 106 as rendering information and sequentially converts it into a print command. At this time, image processing such as color matching, RGB-CMYK conversion, and halftoning processing is executed as needed. The print data processing unit 107 outputs, to the printer 108 of the succeeding stage, a data format that can be interpreted by the printer 108 (e.g., a data format described in a page-description language or a data format rasterized to a print bitmap) as print data.

The processing executed by the computer 100 has been described above. The printer 108 will be described next. Examples of the printer 108 are an inkjet printer, laser beam printer, thermoelectric printer, and dot impact printer. The printer 108 executes print processing on the basis of the print data output from the print data processing unit 107. That is, the print target image (e.g., document image) combined with the first copy-forgery-inhibited-pattern image or second copy-forgery-inhibited-pattern image is printed on a printing medium such as a paper sheet.

With the above-described processing, in, e.g., example 1, when the number of copies printed in the past by Mr. A using the first copy-forgery-inhibited-pattern image is [5] or less, the print target image combined with the first copy-forgery-inhibited-pattern image is printed. When the number of copies is larger than [5], the print target image combined with the second copy-forgery-inhibited-pattern image is printed.

As described above, the first copy-forgery-inhibited-pattern image includes the latent pattern and background pattern (the essence of the following description does not change even when the camouflage pattern is added). Hence, the latent pattern on the printed product is invisible (not completely invisible but hard to perceive) Only when the printed product is copied, the latent pattern becomes visible. That is, if the print condition that "the number of copies that Mr. A can print using the first copy-forgery-inhibited-pattern image is [5] or less" is satisfied, the latent pattern on the printed product is printed as an invisible pattern so that the copy can be used as a printed product.

On the other hand, as described above, the second copy-forgery-inhibited-pattern image includes only the latent pattern. Hence, the latent pattern on the printed product is visible. That is, if the print condition that "the number of copies that Mr. A can print using the first copy-forgery-inhibited-pattern image is [5] or less" is not satisfied, the latent pattern on the printed product is printed as a visible pattern so the copy cannot be used as a printed product.

In printing a copy-forgery-inhibited-pattern image on a printed product, the copy-forgery-inhibited-pattern image can be switched depending on whether the print condition is satisfied. Hence, the security of a printed product can be made higher than before.

The processing of the condition determination unit 102 can have various contents. For example, by applying example 1, printing of two copies using the first copy-forgery-inhibited-pattern image is permitted for Mr. A for a purpose of test print or personal keep. Printing of additional five copies using the first copy-forgery-inhibited-pattern image is permitted for any purpose. From the sixth copy, although printing using the first copy-forgery-inhibited-pattern image is inhibited, printing using the second copy-forgery-inhibited-pattern image is permitted. From the eighth copy, printing itself is inhibited.

In this embodiment, to obtain the copy-forgery-inhibited-pattern image to be used, the condition determination unit 102 determines use of the first copy-forgery-inhibited-pattern image or second copy-forgery-inhibited-pattern image. Then, the image selection unit 103 reads out data necessary for generating the determined copy-forgery-inhibited-pattern image from the image storage unit 104. The copy-forgery-inhibited-pattern image generation unit 105 generates the determined copy-forgery-inhibited-pattern image by using the readout data.

However, from the viewpoint of processing efficiency, a modification to be described below is also possible. The first copy-forgery-inhibited-pattern image and second copy-forgery-inhibited-pattern image are created in advance and stored in the image storage unit 104. The image selection unit 103 reads out, from the image storage unit 104, the copy-forgery-inhibited-pattern image determined by the condition determination unit 102. In this case, the copy-forgery-inhibited-pattern image generation unit 105 can be omitted. The copy-forgery-inhibited-pattern image data read out by the image selection unit 103 is output to the combining unit 106.

Figure 5:
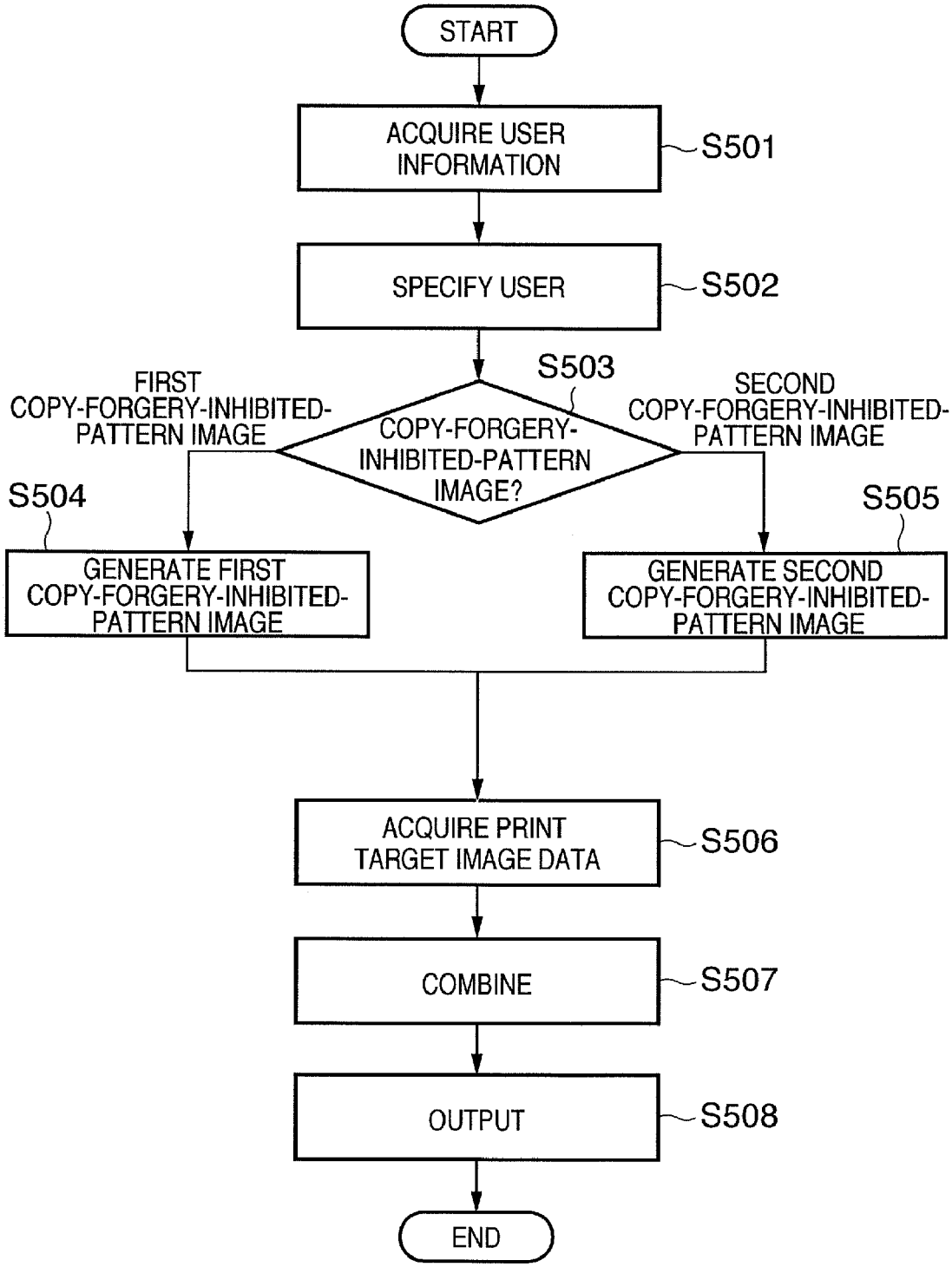
FIG. 5 is a flowchart showing processing executed by the computer 100.

FIG. 5 is a flowchart showing processing executed by the computer 100. The processing in each step shown in FIG. 5 has been described above in detail and will be described here only briefly The authentication unit 101 acquires user information input from the outside (step S501) and specifies user specific information corresponding to the user information, thereby specifying the user (step S502). The specified user specific information is output to the condition determination unit 102.

On the basis of the user specific information received from the authentication unit 101, the condition determination unit 102 determines the copy-forgery-inhibited-pattern image to be used for printing by the user (step S503).

If it is determined to use the first copy-forgery-inhibited-pattern image, the processing advances to step S504. The image selection unit 103 reads out the latent pattern and background pattern from the image storage unit 104 and outputs them to the copy-forgery-inhibited-pattern image generation unit 105. The copy-forgery-inhibited-pattern image generation unit 105 generates the image of the first copy-forgery-inhibited-pattern image by using the received latent pattern and background pattern (step S504). In generating the first copy-forgery-inhibited-pattern image, the camouflage pattern may also be used in addition to the latent pattern and background pattern, as described above.

If it is determined to use the second copy-forgery-inhibited-pattern image, the processing advances to step S505. The image selection unit 103 reads out the latent pattern from the image storage unit 104 and outputs it to the copy-forgery-inhibited-pattern image generation unit 105. The copy-forgery-inhibited-pattern image generation unit 105 generates the image of the second copy-forgery-inhibited-pattern image by using the received latent pattern (step S505).

The combining unit 106 acquires print target image data input from the outside and combines the acquired image data with the copy-forgery-inhibited-pattern image generated by the copy-forgery-inhibited-pattern image generation unit 105 in step S504 or S505, thereby generating combined data (step S507). The print data processing unit 107 executes various processing operations including the above-described various kinds of image processing for the combined data generated by the combining unit 106 in step S507 and outputs the processed data (print data) to the printer 108 (step S508).

Second Embodiment

In this embodiment, a camouflage pattern is used to generate the first copy-forgery-inhibited-pattern image. The camouflage pattern is changed depending on the user. Hence, the user who has instructed to print a printed product can be specified on the basis of the camouflage pattern printed on the printed product. For example, if a printed product is illegally printed, the user who has issued the print instruction can be specified by checking the camouflage pattern printed on the printed product.

For a more detailed description of this embodiment, assume that the sales department in example 2 includes first and second sales sections.

Using this example, processing will be described in which when printing using the first copy-forgery-inhibited-pattern image is to be done, the camouflage pattern to be used to generate the first copy-forgery-inhibited-pattern image is changed for each user. The system configuration of this embodiment is the same as in FIG. 1.

As in the first embodiment, user information is input to an authentication unit 101. The authentication unit 101 inputs user specific information corresponding to the user information to a condition determination unit 102. The condition determination unit 102 holds data indicating departments to which users belong. The condition determination unit 102 determines to use the first copy-forgery-inhibited-pattern image if the user specific information received from the authentication unit 101 indicates a user belonging to the sales department (first sales section or second sales section) and to use the second copy-forgery-inhibited-pattern image if the user specific information indicates a user belonging to the planning department. In this embodiment, the condition determination unit 102 also determines to use a first camouflage pattern if the user specific information received from the authentication unit 101 indicates a user belonging to the first sales section and to use a second camouflage pattern if the user specific information indicates a user belonging to the second sales section.

Figure 4A:
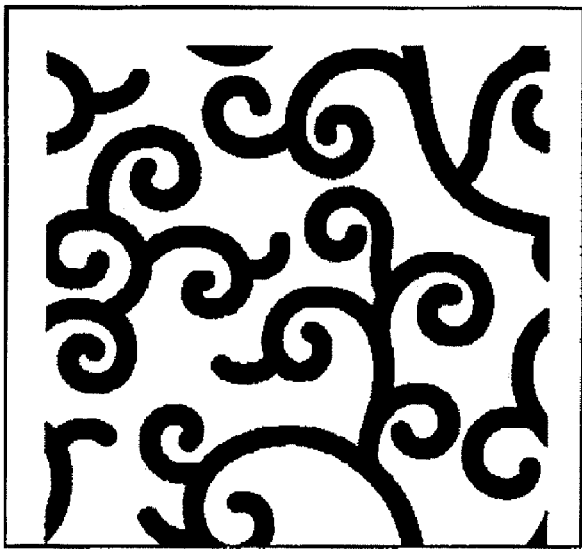
FIG. 4A is a view showing a first camouflage pattern.
Figure 4B:
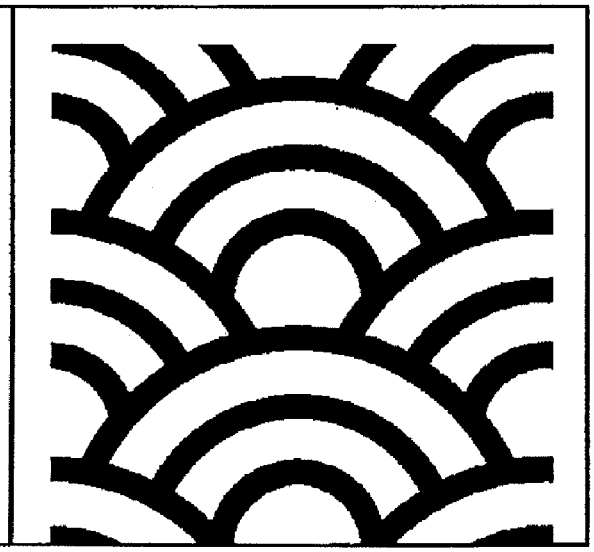
FIG. 4B is a view showing a second camouflage pattern.

In the following description, the first camouflage pattern is an arabesque pattern shown in FIG. 4A, and the second camouflage pattern is a fan-shaped pattern shown in FIG. 4B. The camouflage patterns can have any other design, as a matter of course. FIGS. 4A and 4B are views showing the first and second camouflage patterns, respectively.

The data of the first and second camouflage patterns are stored in an image storage unit 104.

The condition determination unit 102 notifies an image selection unit 103 of a copy-forgery-inhibited-pattern image to be used and a camouflage pattern to be used, as needed. Upon receiving a notification to "use the first copy-forgery-inhibited-pattern image and first camouflage pattern" from the condition determination unit 102, the image selection unit 103 reads out a set of (latent pattern, background pattern, and first camouflage pattern) from the image storage unit 104 and outputs them to a copy-forgery-inhibited-pattern image generation unit 105. Upon receiving a notification to "use the first copy-forgery-inhibited-pattern image and second camouflage pattern" from the condition determination unit 102, the image selection unit 103 reads out a set of (latent pattern, background pattern, and second camouflage pattern) from the image storage unit 104 and outputs them to the copy-forgery-inhibited-pattern image generation unit 105. Upon receiving a notification to "use the second copy-forgery-inhibited-pattern image" from the condition determination unit 102, the image selection unit 103 reads out only the latent pattern from the image storage unit 104 and outputs it to the copy-forgery-inhibited-pattern image generation unit 105.

When the set of (latent pattern, background pattern, and first camouflage pattern) is received, the copy-forgery-inhibited-pattern image generation unit 105 repeatedly pastes the pattern images in a region with a predetermined size without overlap, thereby generating one first copy-forgery-inhibited-pattern image.

When the set of (latent pattern, background pattern, and second camouflage pattern) is received, the copy-forgery-inhibited-pattern image generation unit 105 repeatedly pastes the pattern images in a region with a predetermined size without overlap, thereby generating one first copy-forgery-inhibited-pattern image.

When only the latent pattern is received from the image selection unit 103, the copy-forgery-inhibited-pattern image generation unit 105 repeatedly pastes the image of the received latent pattern in a region with a predetermined size without overlap, thereby generating one second copy-forgery-inhibited-pattern image.

The subsequent processing is fundamentally the same as in the first embodiment.

Third Embodiment

In the first embodiment, the units included in the computer 100 of the system shown in FIG. 1 are formed from hardware. That is, in the first embodiment, the computer 100 is dedicated hardware to provide print data to the printer 108. However, a general PC (Personal Computer) or WS (Workstation) can also be used as the computer 100.

Figure 3:
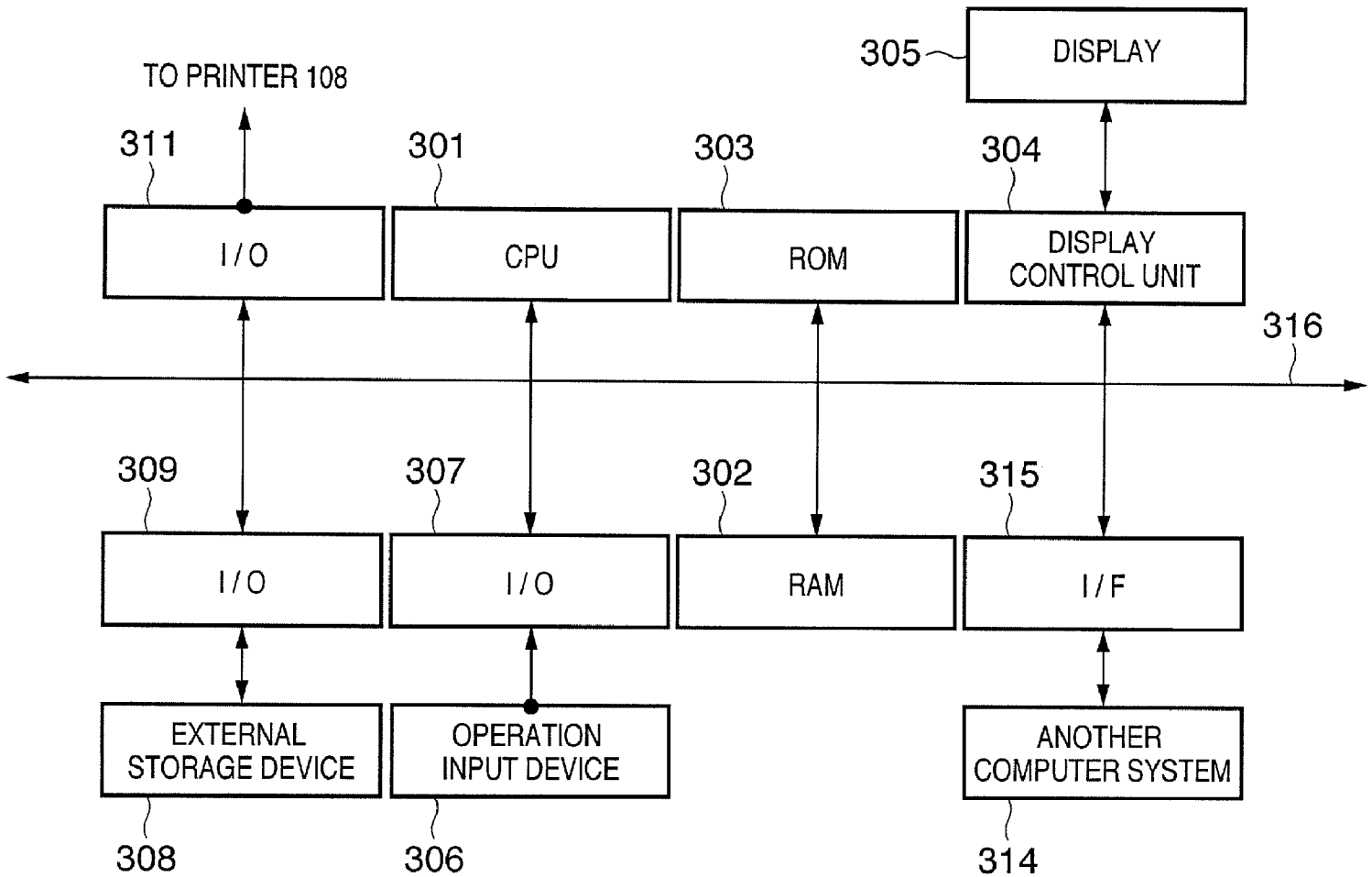
FIG. 3 is a block diagram showing the hardware configuration of a computer 100 including a PC or WS.

FIG. 3 is a block diagram showing the hardware configuration of a computer 100 including a PC or WS.

A CPU 301 controls the entire computer 100 by using programs and data stored in a RAM 302 and a ROM 303. The CPU 301 also functions as the authentication unit 101, condition determination unit 102, image selection unit 103, copy-forgery-inhibited-pattern image generation unit 105, combining unit 106, and print data processing unit 107 shown in FIG. 1.

The RAM 302 can provide various kinds of areas such as an area to temporarily store programs and data loaded from an external storage device 308, an area to temporarily store instruction data input from an operation input device 306, an area to temporarily store programs and data downloaded from another computer system 314, and a work area to be used by the CPU 301 to execute various kinds of processing, as needed.

Some or all of the "data holding" functions of the authentication unit 101, condition determination unit 102, image selection unit 103, copy-forgery-inhibited-pattern image generation unit 105, combining unit 106, and print data processing unit 107 shown in FIG. 1 may be imparted to the RAM 302 or the external storage device 308 to be described later.

The ROM 303 stores setting data and boot programs.

A display control unit 304 executes control processing to display a processing result by the CPU 301 on the display screen of the display 305 as an image or text.

The display 305 can include a CRT or liquid crystal display screen to display a processing result by the CPU 301 as an image or text.

The operation input device 306 includes a keyboard and mouse. The user of the computer 100 can input various kinds of instructions by operating the operation input device 306. For example, user information may be input by using the operation input device 306. The operation input device 306 is connected to a bus 316 through an I/O 307.

The external storage device 308 is a mass storage device represented by a hard disk drive. The external storage device 308 saves, e.g., an OS (Operating System), programs and data to cause the CPU 301 to perform processes that are described as processing executed by the computer 100 in the above embodiments (e.g., programs and data to cause the CPU 301 to function as the authentication unit 101, condition determination unit 102, image selection unit 103, copy-forgery-inhibited-pattern image generation unit 105, combining unit 106, and print data processing unit 107), various kinds of data described as data held by the image storage unit 104, and data which are required as needed in the description of the above embodiments. The programs and data are loaded to the RAM 302 as needed under the control of the CPU 301. The external storage device 308 is connected to the bus 316 through an I/O 309.

An I/O 311 connects the computer 100 to the printer 108. The computer 100 can output print data to the printer 108 through the I/O 311.

Reference numeral 314 denotes another computer system. An I/F (interface) 315 connects the computer 100 to the other computer system 314. The computer 100 can communicate with the other computer system 314 through the I/F 315.

The bus 316 connects the above-described units.

In the above-described embodiments including the third embodiment, the system shown in FIG. 1 is formed by connecting two separate devices, i.e., the computer 100 and printer 108. This system functions as a standalone system. However, the system may be incorporated in one apparatus to form part of a multi function peripheral or copying machine.

The system shown in FIG. 1 can include any number of hardware or software components. That is, in the above-described embodiments, the system includes two devices, i.e., the computer 100 and printer 108. However, only the image storage unit 104 may be provided in another device so that the system includes three devices. An example will be described in the fourth embodiment.

Fourth Embodiment

Figure 2:
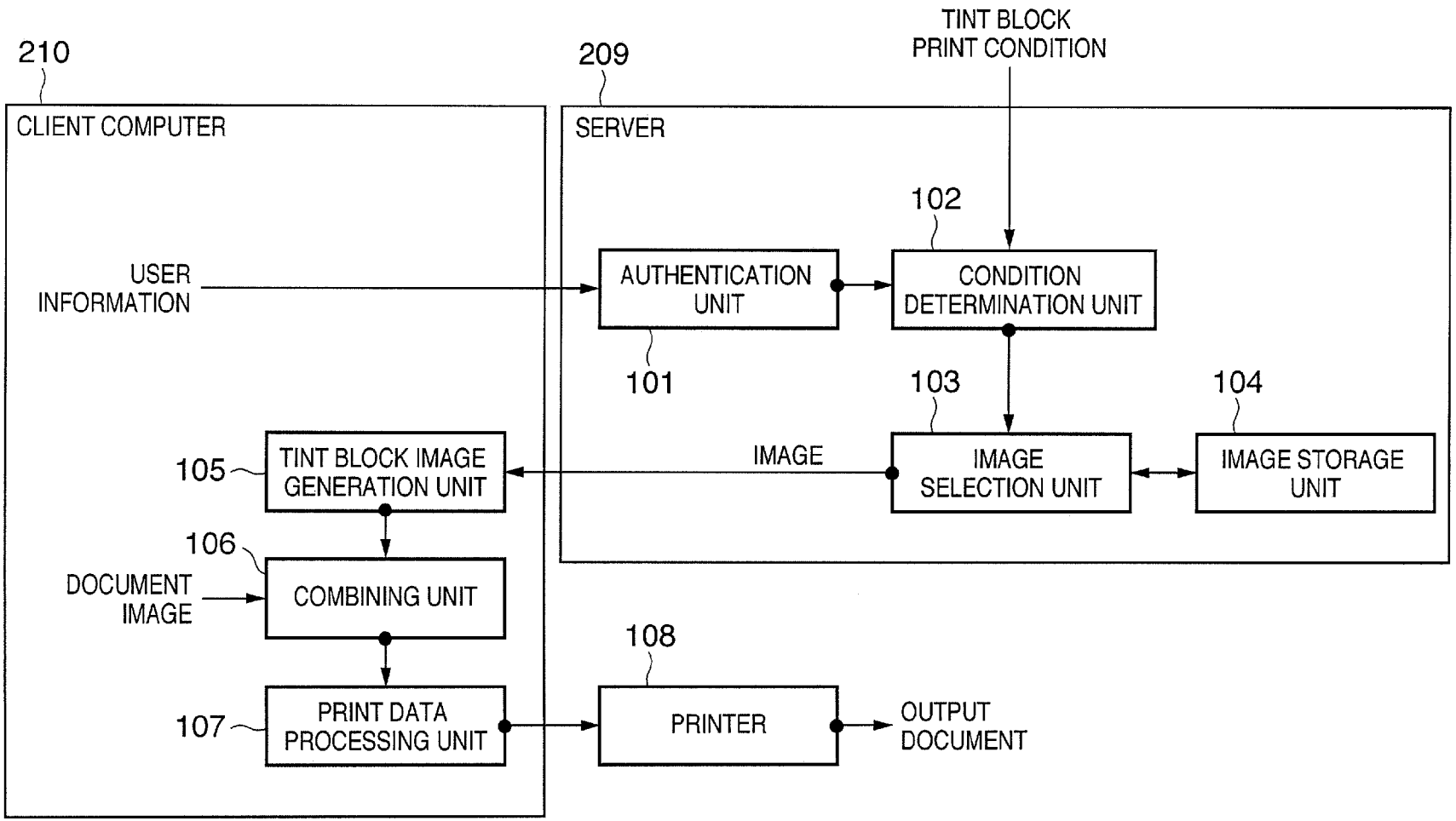
FIG. 2 is a block diagram showing the functional configuration of a system according to the fourth embodiment of the present invention.

In this embodiment, processing executed by the computer 100 in FIG. 1 is distributed to two devices, i.e., a client computer 210 and a server 209. FIG. 2 is a block diagram showing the functional configuration of a system according to this embodiment. As shown in FIG. 2, the system of this embodiment includes a printer 108 and the client computer 210 and server 209 which share the processing executed by the computer 100. The same reference numerals as in FIG. 1 denote the same parts in FIG. 2, and a description thereof will be omitted.

As shown in FIG. 2, the client computer 210 comprises a copy-forgery-inhibited-pattern image generation unit 105, combining unit 106, and print data processing unit 107. The server 209 comprises an authentication unit 101, condition determination unit 102, image selection unit 103, and image storage unit 104. The operations to the units are the same as in the above-described embodiments.

For example, assume that in a network environment wherein a plurality of client computers 210 are connected to the server 209, printing using a copy-forgery-inhibited-pattern image should be executed on the side of each client computer 210. The side of the server 209 holds first and second copy-forgery-inhibited-pattern images, and as needed, a camouflage pattern (or a plurality of kinds of camouflage patterns if a plurality of patterns such as first and second camouflage patterns are necessary). When the client computer 210 transmits user information to the server 209, a copy-forgery-inhibited-pattern image (and a camouflage pattern as needed) allowable for the user is determined on the side of the server 209 in accordance with the same procedures as described in the first and second embodiments. Data necessary for generating the determined copy-forgery-inhibited-pattern image are read out from the image storage unit 104 and transmitted to the client computer 210.

The client computer 210 generates the copy-forgery-inhibited-pattern image by using the transmitted data as in the first embodiment, combines the copy-forgery-inhibited-pattern image with a print target image, executes various kinds of processing including image processing, and outputs the data to the printer 108.

According to this system, an instruction of printing using a copy-forgery-inhibited-pattern image can be issued on the side of each client computer 210 as needed.

In the above-described embodiments including the fourth embodiment, data from the print data processing unit 107 is directly output to the printer 108. However, the present invention is not limited to this. For example, if the printer 108 is connected to a network to function as a network printer, and a printer server is connected to the network, the output destination from the print data processing unit 107 may be the printer server.

The number of printers 108 is not limited to one, and a plurality of printers may be provided. In this case, a printer to be used must be selected on the side of the client computer 210 or computer 100.

In the above-described embodiments including the fourth embodiment, the copy-forgery-inhibited-pattern image or camouflage pattern is changed depending on the user. However, the category to change the pattern is not limited to "user". Various categories such as "department", "corporation", and "country" are available for changing the pattern.

Other Embodiment

The object of the present invention can also be achieved by supplying a recording medium (or storage medium) which records software program codes for implementing the functions of the above-described embodiments to a system or apparatus and causing the computer (or CPU or MPU) of the system or apparatus to read out and execute the program codes stored in the recording medium. In this case, the program codes read out from the recording medium implement the functions of the above-described embodiments by themselves, and the recording medium which stores the program codes constitutes the present invention.

The functions of the above-described embodiments are implemented not only when the readout program codes are executed by the computer but also when the operating system (OS) running on the computer performs part or all of actual processing on the basis of the instructions of the program codes.

The functions of the above-described embodiments are also implemented when the program codes read out from the recording medium are written in the memory of a function expansion card inserted into the computer or a function expansion unit connected to the computer, and the CPU of the function expansion card or function expansion unit performs part or all of actual processing on the basis of the instructions of the program codes.

When the present invention is applied to the recording medium, it stores program codes corresponding to the above-described flowchart.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-172965, filed on Jun. 13, 2005, which is hereby incorporated by reference herein in its entirety.

What is claimed is:

1. A control method of a system, comprising:

a determination step of determining, based on user information, to generate a first image containing a latent pattern and a background pattern, so that a visible pattern appears upon copying the first image, or to generate a second image containing the latent pattern but no background pattern;

a generation step of generating the first image to be combined with a print target image, when it is determined in the determination step to generate the first image, and generating the second image to be combined with the print target image, when it is determined in the determination step to generate the second image;

a combination step of combining the first or second image generated in the generation step with the print target image; and a print step of printing combination data obtained in the combination step, wherein, in the generation step, the second image is generated by repeatedly pasting the latent pattern in a region with a predetermined size without overlap, wherein the system holds first number information indicating the number of copies printed in the past by a user indicated by the user information using the first image, and wherein the determination step includes:

a step of acquiring second number information indicating the number of copies using the first image, which is permitted for the user, and a step of determining to generate the first image when the number indicated by the first number information is equal to or less than the number indicated by the second number information, and determining to generate the second image when the number indicated by the first number information is more than the number indicated by the second number information.

2. The method according to claim 1, wherein wherein the generating step generates the first image so that the latent pattern consists of concentrated dots, so that the latent pattern remains upon copying, and so that the background pattern consists of dispersed dots, so that the background pattern disappears upon copying.

3. The method according to claim 1, wherein when the generating step generates the first image containing the latent pattern and the background pattern, the generating step generates the first image so that a difference between the latent pattern and the background pattern is hard to perceive.

4. The method according to claim 1, wherein it is further determined in the determination step, on the basis of the user information, whether to generate as the first image (i) an image containing the latent pattern, the background pattern, and a first camouflage pattern, or(ii) an image containing the latent pattern, the background pattern, and a second camouflage pattern, the first camouflage pattern being different from the second camouflage pattern.

5. A control method of a computer, comprising:

a determination step of determining, based on user information, to generate a first image containing a latent pattern and a background pattern, so that a visible pattern appears upon copying the first image, or to generate a second image containing the latent pattern but no background pattern;

a generation step of generating the first image to be combined with a print target image, when it is determined in the determination step to generate the first image, and generating the second image to be combined with the print target image, when it is determined in the determination step to generate the second image; and an output step of outputting, to a print device, print data containing the first or second image generated in the generation step, wherein, in the generation step, the second image is generated by repeatedly pasting the latent pattern in a region with a predetermined size without overlap, wherein the computer holds first number information indicating the number of copies printed in the past by a user indicated by the user information using the first image, and wherein the determination step includes:

a step of acquiring second number information indicating the number of copies using the first image, which is permitted for the user, and a step of determining to generate the first image when the number indicated by the first number information is equal to or less than the number indicated by the second number information, and determining to generate the second image when the number indicated by the first number information is more than the number indicated by the second number information.

6. A computer-readable storage medium storing a program which causes a computer to execute the method of claim 5.

7. A system comprising:

a determination unit configured to determine, based on user information, to generate a first image containing a latent pattern and a background pattern, so that a visible pattern appears upon copying the first image, or to generate a second image containing the latent pattern but no background pattern;

a generation unit configured to generate the first image to be combined with a print target image, when it is determined in the determination unit to generate the first image, and to generate the second image to be combined with the print target image, when it is determined in the determination unit to generate the second image;

a combination unit configured to combine the first or second image generated in the generation unit with the print target image; and a print unit configured to print combination data obtained in the combination unit, wherein, in the generation unit, the second image is generated by repeatedly pasting the latent pattern in a region with a predetermined size without overlap, wherein the system holds first number information indicating the number of copies printed in the past by a user indicated by the user information using the first image, and wherein the determination unit includes:

an acquisition unit configured to acquire second number information indicating the number of copies using the first image, which is permitted for the user, and a determination unit configured to determine to generate the first image when the number indicated by the first number information is equal to or less than the number indicated by the second number information, and to generate the second image when the number indicated by the first number information is more than the number indicated by the second number information.

8. The system according to claim 7, wherein the generation unit generates the first image so that the latent pattern consists of concentrated dots, so that the latent pattern remains upon copying, and so that the background pattern consists of dispersed dots, so that the background pattern disappears upon copying.

9. The system according to claim 7, wherein, when said generation unit generates the first image containing the latent pattern and the background pattern, said generation unit generates the first image so that a difference between the latent pattern and the background pattern is hard to perceive.

10. The system according to claim 7, wherein it is further determined in the determination unit, on the basis of the user information, whether to generate as the first image (i) an image containing the latent pattern, the background pattern, and a first camouflage pattern, or (ii) an image containing the latent pattern, the background pattern, and a second camouflage pattern, the first camouflage pattern being different from the second camouflage pattern.

11. A computer comprising:

a determination unit configured to determine, based on user information, to generate a first image containing a latent pattern and a background pattern, so that a visible pattern appears upon copying the first image, or to generate a second image containing the latent pattern but no background pattern;

a generation unit configured to generate the first image to be combined with a print target image, when it is determined in the determination unit to generate the first image, and to generate the second image to be combined with the print target image, when it is determined in the determination unit to generate the second image; and an output unit configured to output, to a print device, print data containing the first or second image generated in the generation unit, wherein, in the generation unit, the second image is generated by repeatedly pasting the latent pattern in a region with a predetermined size without overlap, wherein the computer holds first number information indicating the number of copies printed in the past by a user indicated by the user information using the first image, and wherein the determination unit includes:

an acquisition unit configured to acquire second number information indicating the number of copies using the first image, which is permitted for the user, and a determination unit configured to determine to generate the first image when the number indicated by the first number information is equal to or less than the number indicated by the second number information, and to generate the second image when the number indicated by the first number information is more than the number indicated by the second number information.

* * * * *